US010388253B2

(12) United States Patent
Nakagoshi

(10) Patent No.: US 10,388,253 B2
(45) Date of Patent: Aug. 20, 2019

(54) PROCESSING DEVICE, DISPLAY SYSTEM, DISPLAY METHOD, AND PROGRAM

(71) Applicant: JVC KENWOOD Corporation, Kokohama-shi, Kanagawa (JP)

(72) Inventor: Ryosuke Nakagoshi, Yokohama (JP)

(73) Assignee: JVC KENWOOD CORPORATION, Kanagawa (JP)

( * ) Notice: Subject to any disclaimer, the term of this patent is extended or adjusted under 35 U.S.C. 154(b) by 58 days.

(21) Appl. No.: 15/662,602

(22) Filed: Jul. 28, 2017

(65) Prior Publication Data

US 2018/0033401 A1 Feb. 1, 2018

(30) Foreign Application Priority Data

Jul. 29, 2016 (JP) ..... 2016-149152

(51) Int. Cl.
*G09G 5/02* (2006.01)
*G09G 5/10* (2006.01)
*G09G 5/00* (2006.01)

(52) U.S. Cl.
CPC ..... *G09G 5/10* (2013.01); *G09G 5/006* (2013.01); *G09G 5/02* (2013.01); *G09G 2320/0271* (2013.01); *G09G 2320/0646* (2013.01); *G09G 2360/16* (2013.01)

(58) Field of Classification Search
None
See application file for complete search history.

(56) References Cited

U.S. PATENT DOCUMENTS 9,058,510 B1 * 6/2015 Bold ..... G06T 11/00
9,571,759 B1 * 2/2017 Adsumilli ..... H04N 9/77
2009/0059097 A1 * 3/2009 Miura ..... H04N 9/3182 348/751
2018/0012565 A1 * 1/2018 Dunn ..... G09G 3/3406

FOREIGN PATENT DOCUMENTS

JP 2005-267185 9/2005

* cited by examiner

*Primary Examiner* — Saptarshi Mazumder
(74) *Attorney, Agent, or Firm* — Procopio, Cory, Hargreaves & Savitch LLP

(57) ABSTRACT

A display system, a display device, a processing device, a display method, and a program capable of displaying a CG video image with a wide dynamic range are provided. A display system according to an embodiment includes a processor that generates a CG video image according to a scene, and a projector that display the CG video image. The display system generates a normalizing level, a brightness compression level, and a brightness control signal based on brightness information of the scene. The display system generates a video signal including pixel data of a display video image from a rendering video image by compressing brightness of a pixel present in a brightness compression range specified by the brightness compression level and the normalizing level in the rendering video image.

11 Claims, 16 Drawing Sheets

Fig. 4

PROCESSING DEVICE, DISPLAY SYSTEM, DISPLAY METHOD, AND PROGRAM

CROSS REFERENCE TO RELATED APPLICATION

This application is based upon and claims the benefit of priority from Japanese patent application No. 2016-149152, filed on Jul. 29, 2016, the disclosure of which is incorporated herein in its entirety by reference.

BACKGROUND

The present disclosure relates to a processing device, a display system, a display method, and a program.

Japanese Unexamined Patent Application Publication No. 2005-267185, which relates to the field of computer graphics (CG), discloses an image display device that displays a three-dimensional (3D) object to be displayed in three dimensions. This image display device includes a rendering unit that converts polygonal data of a 3D object into two-dimensional (2D) pixel data. It should be noted that the 2D pixel data includes brightness value data and depth data representing information on a depth direction. The brightness value data is formed as data that is associated with the coordinates of a respective pixel and represents its brightness value and color (RGB).

In an IG (Image Generator) that generates the above-described CG video image, the brightness of each pixel can be set to any value from zero to infinity. However, there is a limit to the brightness of a display device (a display) that displays the CG video image. Further, the dynamic range (brightness and contrast) of the display device is constant. Therefore, it is very difficult to appropriately display virtual brightness of the CG video image.

For the interface (I/F) connecting the IG with the display device, a general-purpose interface such as an HDMI (Registered Trademark) (High Definition Multimedia Interface), a DisplayPort, a DVI (Digital Visual Interface), and an SDI (Serial Digital Interface) is often used for video signals. Further, a general-purpose I/F such as a LAN (Local Area Network) and an RS-232C is often used for control (i.e., for control signals). By controlling the brightness of the display device by using the above-described general-purpose I/F for control, the dynamic range can be expanded. However, it is very difficult to control the brightness on a frame-by-frame basis in a video image by using the above-described general-purpose I/F for control. Further, a video signal is not optimized by using the control of the brightness of the display alone. Therefore, there is a problem that the gradation property is poor, in particular, in dark video images.

SUMMARY

A processing device according to an aspect of an embodiment is a processing device including a processor configured to generate a video signal for displaying a CG video image according to a scene, the processing device being configured to: perform a rendering of a rendering video image based on object information about an object; generate a normalizing level, a brightness compression level, and a brightness control signal for setting brightness of a frame of a display video image based on brightness information of the scene; and generate a video signal including pixel data of the display video image from the rendering video image by compressing brightness of a pixel present in a brightness compression range specified by the brightness compression level and the normalizing level in the rendering video image.

A display method according to an aspect of an embodiment is a display method for displaying a CG video image according to a scene, including: a step of performing a rendering of a rendering video image based on object information about an object; a step of generating a normalizing level, a brightness compression level, and a brightness control signal for setting brightness of a frame of a display video image based on brightness information of the scene; a step of generating a video signal including pixel data of the display video image from the rendering video image by compressing brightness of a pixel present in a brightness compression range specified by the brightness compression level and the normalizing level in the rendering video image; and a step of displaying the CG video image based on the video signal with brightness corresponding to the brightness control signal.

A program according to an aspect of an embodiment is a program for generating a video signal for displaying a CG video image according to a scene, the program being adapted to cause a computer to execute: a step of performing a rendering of a rendering video image based on object information about an object; a step of generating a normalizing level, a brightness compression level, and a brightness control signal for setting brightness of a frame of a display video image based on brightness information of the scene; and a step of generating a video signal including pixel data of the display video image from the rendering video image by compressing brightness of a pixel present in a brightness compression range specified by the brightness compression level and the normalizing level in the rendering video image.

According to the embodiment, it is possible to provide a display system, a display device, a processing device, a display method, and a program capable of displaying a CG video image with a wide dynamic range.

BRIEF DESCRIPTION OF THE DRAWINGS

The above and other aspects, advantages and features will be more apparent from the following description of certain embodiments taken in conjunction with the accompanying drawings, in which.

DETAILED DESCRIPTION

The program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (compact disc read only memory), CD-R (compact disc recordable), CD-R/W (compact disc rewritable), and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

<Display System>

A display system according to this embodiment is a display system for displaying a video image of data having a brightness gradation that is wider than a brightness gradation that can be expressed (i.e., displayed) by a display device. Examples of the display system include a flight simulator, a drive simulator, a ship simulator, architecture VR (Virtual Reality), and interior VR. The below-shown example is explained on the assumption that the video image is a CG video image and the display system is a flight simulator for training a pilot.

The display system displays a CG video image based on virtual (or hypothetical) object information. For example, the display system stores data of an earth's surface including structures as object information in advance. Further, the display system stores airframe data of an airplane, light source data, and so on in advance. Further, the display system generates a virtual rendering video image (i.e., performs a rendering of a virtual rendering video image) based on the object information and the like. The rendering video image is a CG video image having a dynamic range wider than the contrast of the display.

The display system generates a video signal for display based on the rendering video image. Further, the display system generates a brightness control signal for a display video image displayed on the display based on predefined brightness information. Then, the display device (the display) displays the CG video image based on the video signal for display and the brightness control signal.

Figure 1:
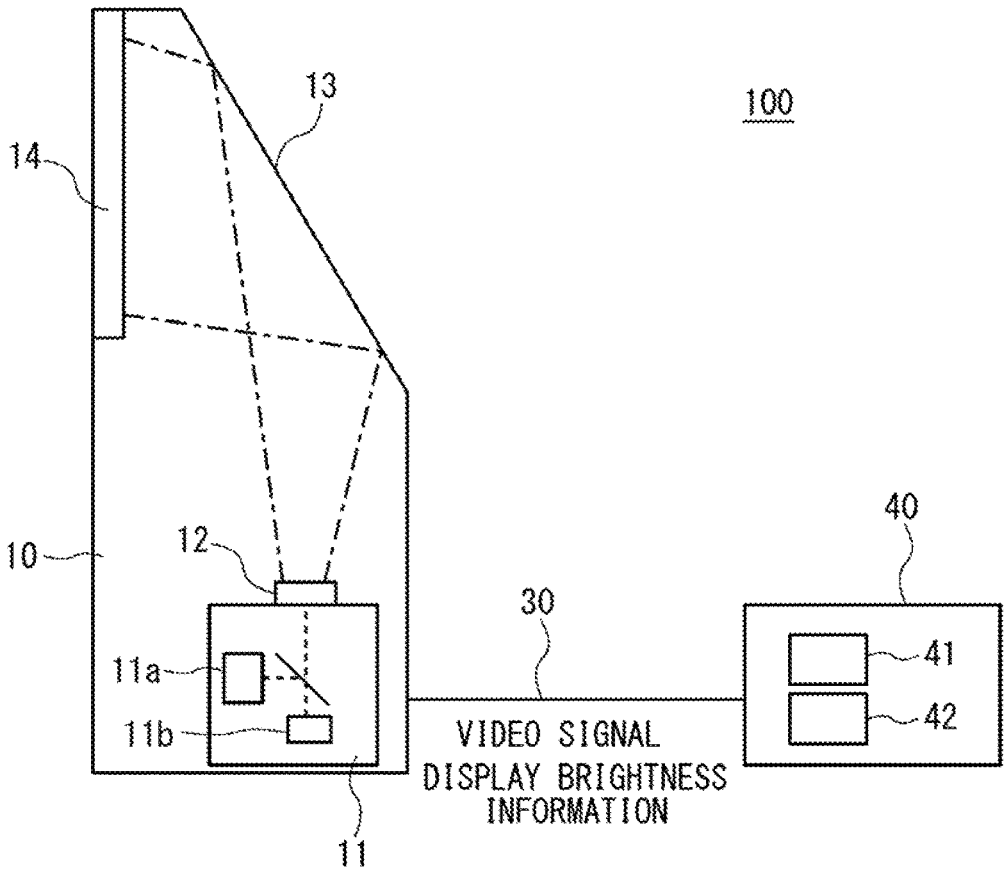
FIG. 1 shows an overall configuration of an HDR-compliant display system.

FIG. 1 shows an overall configuration of a display system. A display system 100 includes a projector 10, an interface unit 30, and a processing device 40.

The projector 10 is an HDR-compliant display (display device), and displays a video of a moving image or a still image. In the case where the display system 100 is used for a flight simulator, the projector 10 displays a video image that a user (e.g., a pilot) can see through a window of an airplane. For example, the projector 10 displays a video image based on 12-bit RGB video signal. That is, in each pixel of the RGB of the projector 10, it is displayed with one of gradation levels 0 to 4,095. Note that in the following explanation, pixel data is a value indicating a gradation value of each pixel of the RGB.

The projector 10 is a rear projection type projector (i.e., a rear projector) and includes a projection unit 11, a projection lens 12, a mirror 13, and a screen 14. Note that although this embodiment is explained on the assumption that the display is the rear projection type projector 10, a reflection type projector or other types of displays (display devices) such as a plasma display, a liquid-crystal display, and an organic EL (Electroluminescent) display may be used as the display.

The projection unit 11 generates projection light based on a video signal in order to project a video image onto the screen 14. For example, the projection unit 11 includes a light source 11*a* and a spatial modulator 11*b*. The light source 11*a* is a lamp, an LD(s) (Laser Diode), an LED(s) (Light Emitting Diode), or the like. The spatial modulator 11*b* is an LCOS (Liquid-crystal On Silicon) panel, a transmission type liquid-crystal panel, a DMD (Digital Mirror Device), or the like. In this example, the light source 11*a* is an LD(s) of the RGB and the spatial modulator 11*b* is an LCOS panel.

The projection unit 11 modulates light emitted from the light source 11*a* by using the spatial modulator 11*b*. Then, the light modulated by the spatial modulator 11*b* is output from the projection lens 12 as projection light. The projection light from the projection lens 12 is reflected on the mirror 13 toward the screen 14. The projection lens 12 includes a plurality of lenses and projects a video image from the projection unit 11 onto the screen 14 in an enlarged size.

For example, the spatial modulator 11*b* modulates light from the light source 11*a* based on pixel data included in the video signal. As a result, light having an amount of light (hereinafter referred to as a "light amount") corresponding to pixel data is incident on a respective pixel in the screen 14. Then, scattered light scattered by the screen 14 is incident on user's pupils. In this way, the user can visually recognize the CG video image displayed on the screen 14.

Further, the light source 11*a* generates light having a light amount that is determined based on the brightness control signal. That is, the output of the light source 11*a* is controlled based on the brightness control signal. Examples of the control of the LD, which is the light source 11*a*, include current control and PWM (Pulse Width Modulation) drive control.

The processing device 40 is an IG (Image Generator) that generates a CG video image. The processing device 40 includes a processor 41 and a memory 42 for generating a video signal and a brightness control signal. Note that although one processor 41 and one memory 42 are shown in FIG. 1, the number of each of the processor 41 and the memory 42 may be more than one.

For example, the memory 42 stores a computer program for performing image processing in advance. Further, the processor 41 reads the computer program from the memory 42 and executes the computer program. By doing so, the processing device 40 generates a video signal and a brightness control signal. Note that the video signal includes pixel data corresponding to a gradation value of a respective pixel. The pixel data of the video signal is 12-bit RGB data as described above. Further, the memory 42 memorizes (i.e., stores) various settings and data for performing a simulation.

For example, the processing device 40 is a personal computer (PC) or the like including a CPU (Central Processing Unit), a memory, a graphic card, a keyboard, a mouse, input/output ports (input/output I/F), and so on. Examples of the input/output port for receiving/outputting video signals include an HDMI, a DisplayPort, a DVI, and an SDI.

The interface unit 30 includes an interface between the processing device 40 and the projector 10. That is, signals are transmitted between the processing device 40 and the projector 10 through the interface unit 30. Specifically, the interface unit 30 includes an output port for the processing device 40, an input port for the projector 10, and an AV (Audio Visual) cable or the like for connecting the output port and the input port to each other. For the interface unit 30, a general-purpose I/F for a video signal such as an HDMI, a DisplayPort, a DVI, and an SDI can be used as described above.

<Outline of Image Processing>

Figure 2:
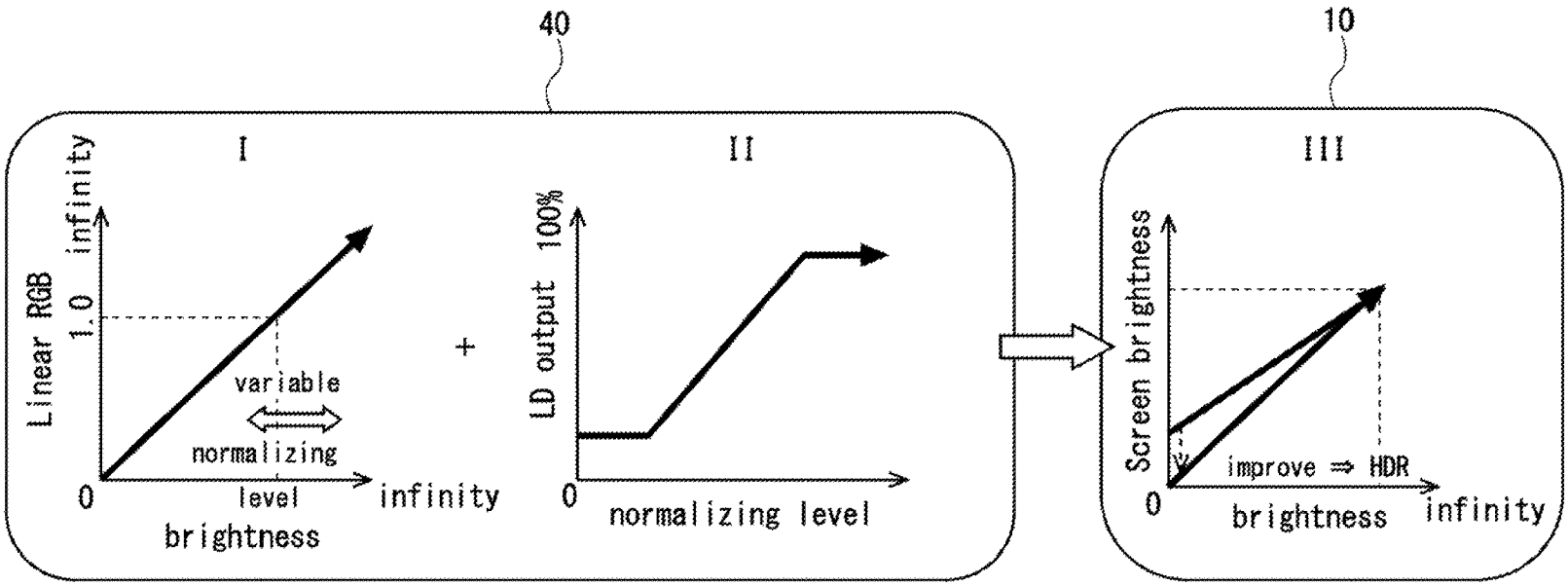
FIG. 2 is a diagram for explaining an outline of image processing in a display system.

An outline of image processing according to this embodiment is explained hereinafter with reference to FIG. 2. FIG. 2 is a diagram (i.e., graphs) for explaining a process performed in the processing device 40 and a display video image displayed by the projector 10. In a rendering video image generated by CG processing, it is possible to set virtual brightness to any value from zero to nearly infinity. Therefore, as indicated by a horizontal axis of a graph I shown in FIG. 2, each pixel in a rendering video image is expressed by virtual brightness from zero to nearly infinity, e.g., expressed by levels equivalent to 32 bits.

However, there is a limit to the brightness of the projector 10. That is, the brightness that the projector 10 can display is set according to the output level of the light source 11*a* or the like. Therefore, if the output level of the light source 11*a* is set according to the pixel having the maximum brightness in the rendering video image, it is very difficult to appropriately display a dark pixel.

Therefore, the processing device 40 defines a normalizing level according to a scene. The normalizing level is a level corresponding to the upper limit (or a level for coping with the upper limit) of virtual brightness in one frame of a video image. The processing device 40 normalizes the rendering video image by using the normalizing level. For example, as shown in the graph I in FIG. 2, the rendering video image is normalized so that the maximum virtual brightness value in each frame in the processing device 40 becomes one. Therefore, in the normalized rendering video image, pixel data (linear RGB) is expressed in a range of zero to one. The normalizing level can be changed according to the frame (i.e., for each frame) so that each frame can be displayed with an appropriate brightness. For example, the processing device 40 sets the normalizing level according to brightness information of a scene. The processing device 40 generates a video signal based on the normalized rendering video image.

Further, as shown in a graph II in FIG. 2, the processing device 40 generates a brightness control signal according to the normalizing level. The brightness control signal corresponds to the output level (the LD output) of the light source 11*a*. For example, the brightness control signal is expressed by a value from 0 to 100%. When the brightness control signal is 100%, the output of the light source 11*a* is maximized. The brightness control signal is set for each frame.

The processing device 40 transmits the video signal and the brightness control signal to the projector 10 through the interface unit 30. The projector 10 displays a CG video image according to the video signal and the brightness control signal. The projector 10 changes the output level of the light source 11*a* for each frame according to the brightness control signal. Further, the projector 10 displays the CG video image with an optimal output level of the light source 11*a* for each frame. By doing so, the dynamic range can be expanded as shown in a graph III in FIG. 2.

<Generation of Rendering Video Image and Brightness Information>

Figure 3:
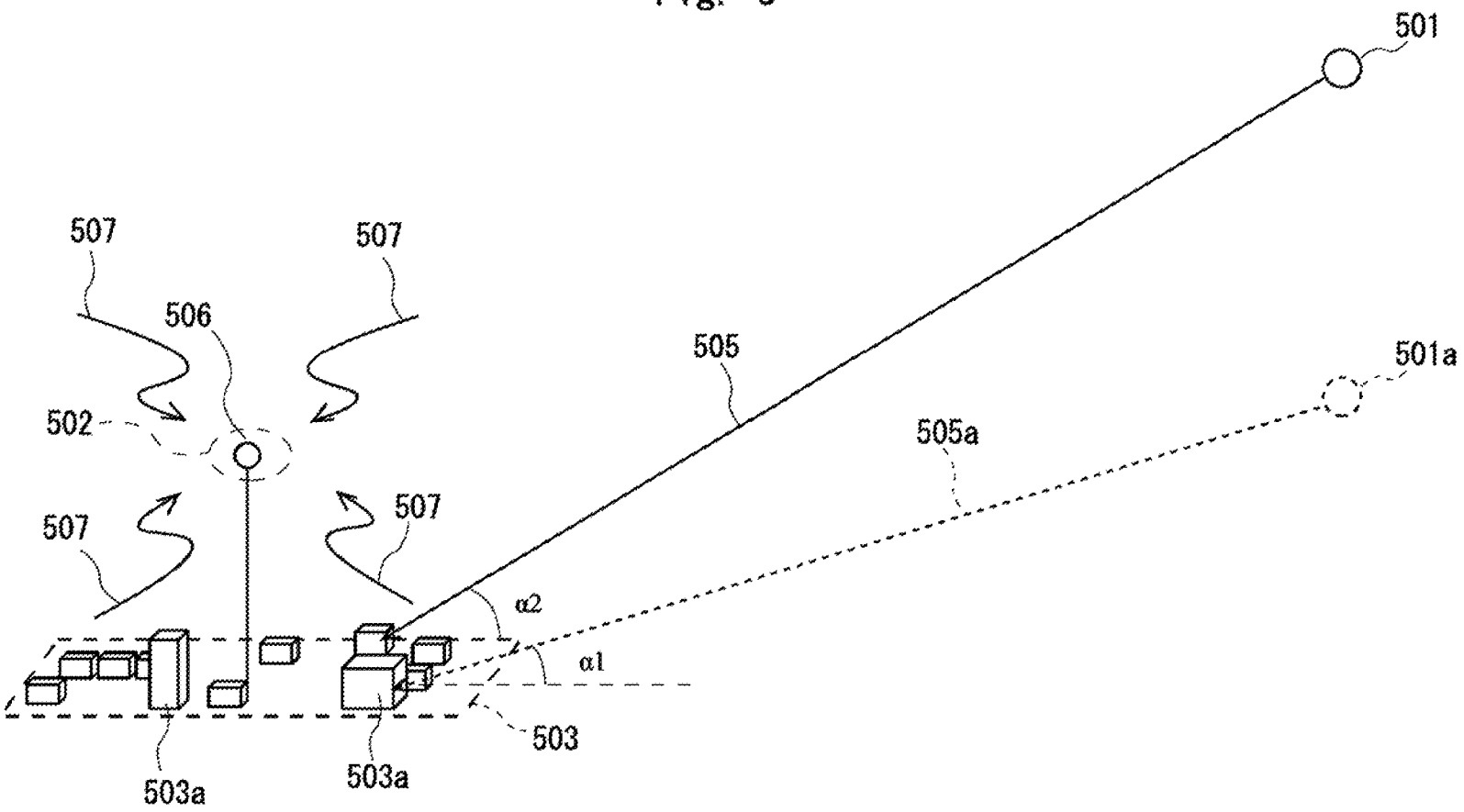
FIG. 3 is a diagram for explaining object information in a processing device.

Details of image processing are explained hereinafter with reference to the drawings. FIG. 3 is a diagram for explaining virtual object information in the processing device 40. As shown in FIG. 3, data of an earth's surface 503 including a structure 503*a* is stored in the memory 42. Further, data of a light source 501 and an airframe 502 are stored as light source information and airframe information, respectively, in the memory 42. Further, the processing device 40 generates a rendering video image in an example case in which the light source 501, the airframe 502, and the earth's surface 503 are disposed in a virtual space.

The light source 501 may be the sun, stars, the moon, or the like. Alternatively, the light source 501 may be an artificial light source such as a guide beacon, a fluorescent light, an LED(s), or the like. The light source information of the light source 501 includes spatial data about the position, the angle, the size, and the shape of the light source, and data about brightness. The positions of the sun, stars, the moon, and the like change according to the time.

The airframe 502 corresponds to an airplane controlled (i.e., piloted) by a user. The airframe information of the airframe 502 includes spatial data about the size and the shape of the airplane. There is a user's point of view (hereinafter referred to as a "viewpoint") 506 in the cockpit of the airframe 502. The position of the airframe 502 changes according to the control by the user.

The earth's surface 503 corresponds to a ground including the structure 503*a*. Examples of the structure 503*a* include a runway, a building near an airport, and an antenna. The object information of the earth's surface 503 includes spatial data about the height (or undulations) of the ground. The object information of the structure 503*a* includes spatial data about the position, the size, and the shape of the structure 503*a*. Further, the object information includes optical data about the optical reflectivity of the earth's surface 503 and the structure 503*a*.

The processing device 40 obtains (i.e., determines) the brightness of incident light incident on the viewpoint 506 based on the object information of the earth's surface 503 including the light source, the airframe, and the structure 503*a*. For example, the processing device 40 performs a rendering of a rendering video image by performing various types of processing such as modeling, lighting, and shading for an object. That is, the processing device 40 calculates virtual brightness of each pixel in the rendering video image. Note that the rendering video image is a video image that is cut out from an image viewed from the viewpoint 506 at a predetermined viewing angle.

The user performs an input operation by using a control stick or the like in order to control (i.e., pilot) the airframe 502. The processing device 40 calculates a change in the airframe of the airplane in the virtual space according to the input and calculates a change in the viewpoint. The processing device 40 extracts ambient light information at the calculated viewpoint in the virtual space and generates brightness information. The processing device 40 performs a rendering of a picture that is viewed from the calculated viewpoint in the virtual space.

In the case where the light source 501 is the sun, light from the light source 501 is parallel light 505. The parallel light 505 from the light source 501 is incident on the structure 503*a* and the earth's surface 503, and reflected thereon in a diffused manner. Then, the diffuse-reflected light, i.e., the light reflected on the group of objects such as the structure 503*a* in the diffused manner, is incident on the viewpoint 506 as ambient light 507.

For example, the angle of the light source 501 changes according to the time (a light source 501*a* in FIG. 3). As the angle of the light source 501 changes, the direction in which the parallel light 505 is incident changes (e.g., parallel light 505*a*). The brightness of the incident light incident on the viewpoint 506 changes according to the positional relation between the light source 501 and the user's viewpoint 506. That is, the brightness at the viewpoint 506 changes according to the time.

Regarding the intensity of the ambient light 507 around the viewpoint 506, the diffuse-reflected light from the structure 503*a* and the earth's surface 503 and the light diffused in the sky except for the direct light from the sun are dominant compared to the direct light that directly comes from the light source 501 and is incident on the viewpoint 506. This is because if direct light having brightness close to infinity such as light from the sun is used as the ambient light 507, the intensity of the ambient light 507 becomes so high that a video image having unnatural brightness is displayed in the display device.

For example, in the case where the earth's surface 503 and the structure 503*a* are positioned in a surface sufficiently large for the viewpoint 506, when the angle between a line connecting the light source 501 that is sufficiently far away from the viewpoint 506 with the viewpoint 506 and the surface (i.e., the ground) becomes smaller, the amount of received light per unit area on the surface decreases. Therefore, the brightness of the ambient light 507 around the viewpoint 506 becomes darker (i.e., decreases).

Specifically, in the morning or the evening, the angle between the line connecting the sun, which is the light source 501, with the viewpoint 506 and the ground (i.e., an angle $\alpha$1 in FIG. 3) decreases. In contrast to this, in the daytime, the angle between the line connecting the sun, which is the light source 501, with the viewpoint 506 and the ground (i.e., an angle $\alpha$2 in FIG. 3) increases. Therefore, the brightness of the ambient light 507 around the viewpoint 506 in the morning or the evening is darker (i.e., smaller) than the brightness in the daytime. As described above, the brightness of a scene changes according to the time of day.

The processing device 40 holds information defining brightness information of a scene that changes according to the time. The brightness information of a scene can be obtained by simulating changes in terrestrial brightness throughout a day. For example, brightness information of a scene can be obtained according to the angle of the parallel light 505 coming from the sun.

Figure 4:
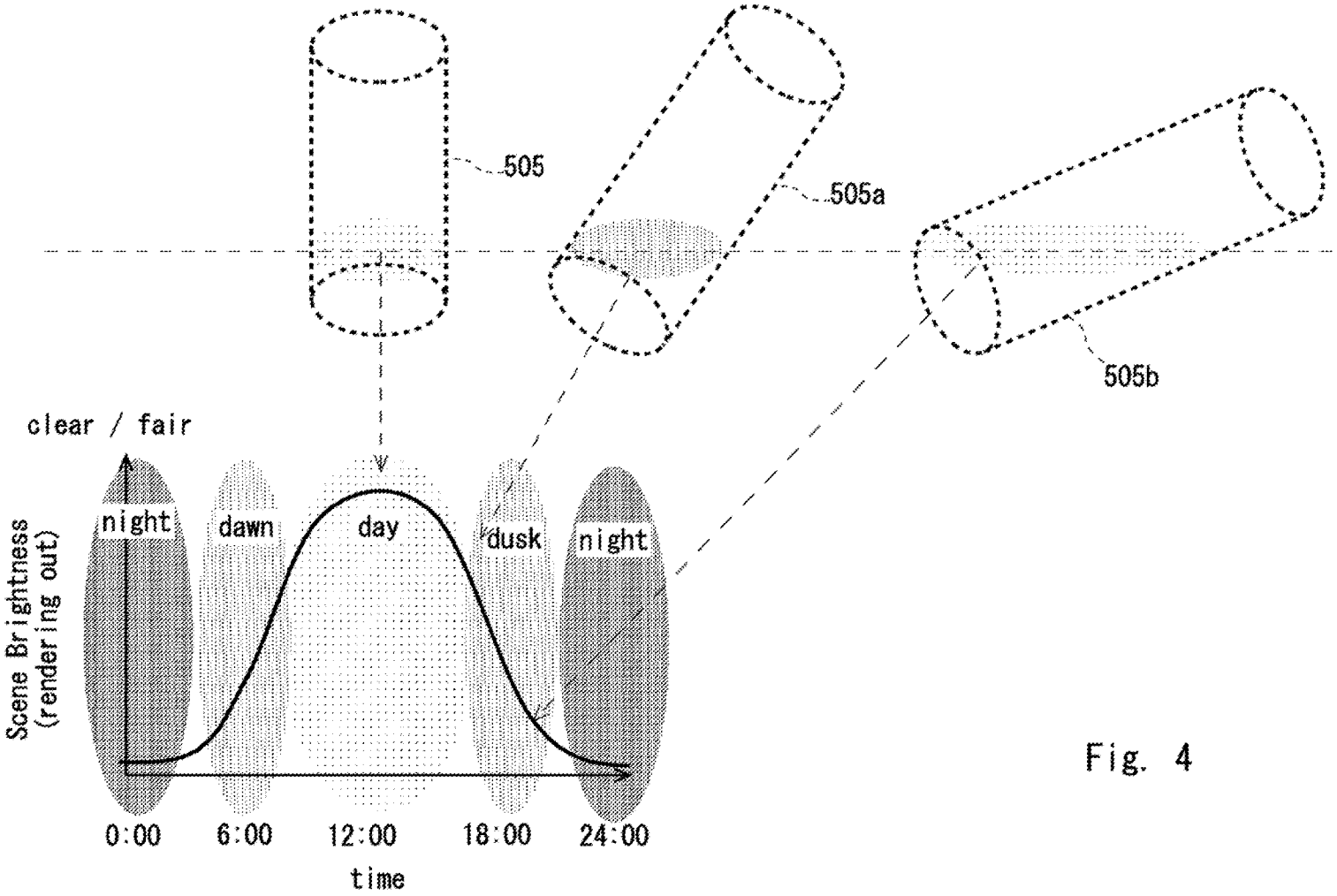
FIG. 4 is a graph showing changes in brightness information of a scene over time in fine weather.

FIG. 4 shows an example of brightness information in fine weather. In FIG. 4, the horizontal axis indicates time of day (0:00 to 24:00) and the vertical axis indicates brightness information of a scene (Scene Brightness). The incident angle of the parallel light 505 from the light source 501, which is the sun, changes according to the time. The brightness of a scene is maximized at twelve noon and becomes darker (i.e., decreases) as the time approaches midnight.

Specifically, the angle between the light source 501 (i.e., the light from the light source 501) and the ground is maximized at twelve noon as described above. That is, the direction of the parallel light 505 is close to the direction perpendicular to the ground. Therefore, the amount of received light per unit area on the earth's surface 503 increases and hence the scene becomes brighter. As indicated by parallel light 505*a* and 505*b* in FIG. 4, the direction of the parallel light 505 gets closer to the direction parallel to the earth's surface 503 as the time changes from twelve noon to sunset. The direction of the parallel light 505 gets closer to the direction perpendicular to the earth's surface 503 as the time changes from sunrise to twelve noon.

Figure 5:
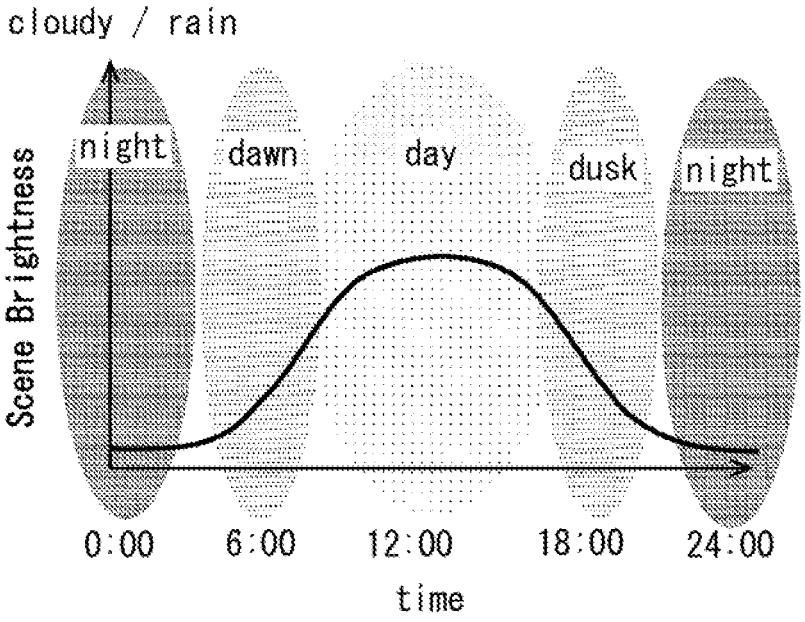
FIG. 5 is a graph showing changes in brightness information of a scene over time in cloudy/rainy weather.

Further, FIG. 5 shows brightness information of a scene in cloudy/rainy weather. Similarly to the case of fine weather, the brightness of a scene is also maximized at twelve noon and becomes darker (i.e., decreases) as the time approaches midnight in cloudy/rainy weather. Further, brightness information of a scene in cloudy/rainy weather is darker (i.e., lower) than that in fine weather when they are compared at the same time of day. That is, although the angle of the parallel light 505 in cloudy/rainy weather is the same as that in fine weather, the scene is darker in cloudy/rainy weather than that in fine weather.

The angle of the parallel light 505 with respect to the ground changes according to the position of the sun. The processing device 40 can define brightness information as a function of the angle $\alpha$ of the parallel light 505 with respect to the ground. Further, the processing device 40 sets the brightness information according to weather. By doing so, it is possible to easily calculate the brightness information. Further, the brightness information of a scene can be set before generating a CG video image. For example, the angle of the sun is simulated according to the setting time at which the simulation is performed. Then, the processor 41 can calculate the brightness information according to the angle of the sun in advance. Further, the processor 41 writes (i.e., records) the brightness information, which is calculated in advance, in the memory 42.

As described above, the brightness information of the scene (Scene Brightness) changes with time. In other words, the brightness information changes for each frame. Further, brightness information throughout a day is defined for each type of weather. For example, for each type of weather, the data in the graph shown in FIG. 4 or 5 is stored as brightness information in the memory 42. The memory 42 may store data of brightness information in the form of a table or in the form of a function.

Although weather is classified into two categories i.e., fine weather and cloudy/rainy weather in the above explanation, weather may be classified into smaller categories. That is, weather may be classified into three or more categories. Then, the change in brightness information over time may be defined for each category of weather. As described above, the brightness information of a scene changes according to the weather and according to the time. Further, the brightness information may change according to the altitude of the viewpoint 506, the season, and so on. In such a case, the processing device 40 generates brightness information that changes over time according to the weather, the season, and the altitude. Further, the brightness information does not necessarily have to be defined for the whole day. That is, the brightness information may be defined for the time period(s) in which a simulation is performed by using a flight simulator. Therefore, in the case where a user enters date and time at which the user performs a simulation, the processing device 40 may calculate data of brightness information according to the entered date and time (i.e., for the entered date and time).

Further, the brightness information of a scene can be calculated based on a rendering video image. For example, it is possible to calculate brightness information from the sum total of incident light incident on the viewpoint 506. Specifically, an average brightness APL (Average Picture Level) of one or a plurality of rendering video images is defined as brightness information of a scene. That is, an average value of virtual brightness of a rendering video image(s) can be used as brightness information of a scene. The higher the average brightness is, the brighter the scene becomes. Further, the lower the average brightness is, the darker the scene becomes. In such a case, the brightness information of a scene may be an average brightness throughout the frame or an average brightness of a local part of the frame. Further, an average brightness APL of rendering video images of two or more frames may be used as brightness information.

<Generation of Normalizing Level and Brightness Compression Level>

Figure 6:
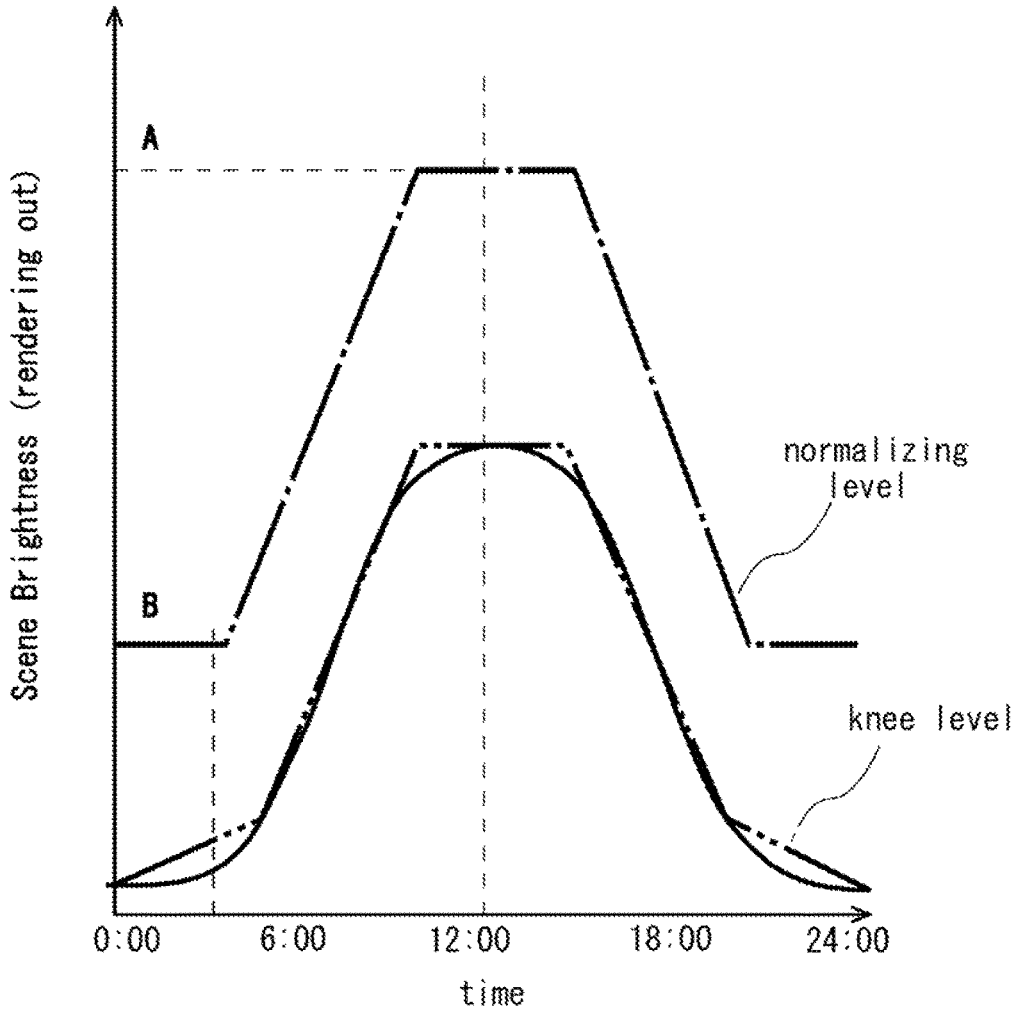
FIG. 6 is a graph showing changes in brightness information, a normalizing level, and a brightness compression level over time in fine weather.
Figure 7:
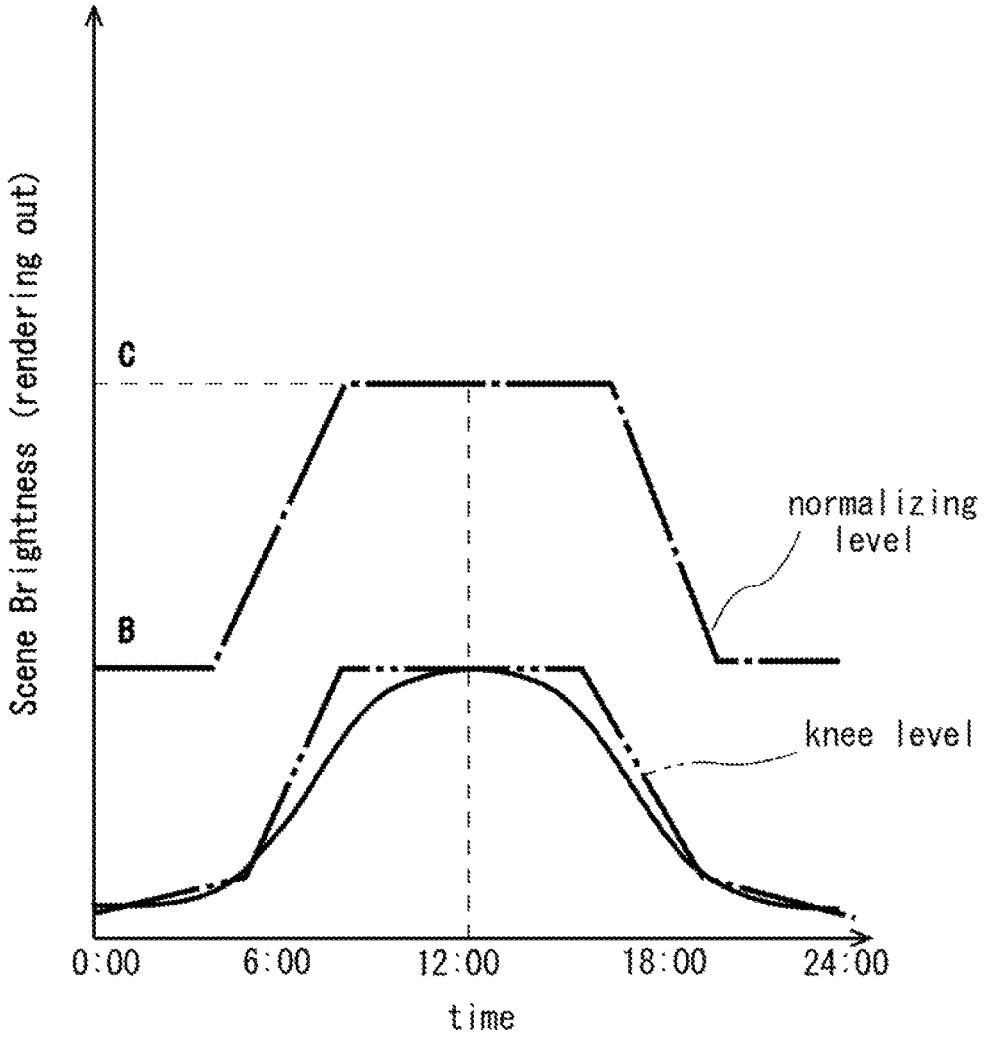
FIG. 7 is a graph showing changes in brightness information, a normalizing level, and a brightness compression level over time in cloudy/rainy weather.

The processing device 40 calculates a normalizing level and a brightness compression level based on brightness information of a scene. Each of FIGS. 6 and 7 shows changes in normalizing level and changes in brightness compression level (knee level) from 0 o'clock to 24 o'clock. FIG. 6 shows normalizing levels (a chain line) and brightness compression levels (a chain double-dashed line) in fine weather. Further, FIG. 7 shows normalizing levels (a chain line) and brightness compression levels (a chain double-dashed line) in cloudy/rainy weather. Further, in FIGS. 6 and 7, the brightness information shown in FIGS. 4 and 5 is indicated by solid lines.

As described above, the normalizing level is a level corresponding to the upper limit in a frame. The brightness compression level is a level based on which the brightness is compressed in a frame. That is, when the brightness of a pixel in a rendering video image is no lower than the brightness compression level and no higher than the normalizing level, the brightness is compressed. As described above, the normalizing level and the brightness compression level define a brightness compression range in which the brightness is compressed.

The brightness compression level increases as the brightness information of a scene increases and decreases as the brightness information of a scene decreases. Further, the normalizing level changes according to the assumed (or estimated) maximum brightness in the scene. Note that the brightness information of a scene may be the brightness of a rendering video image. However, since the size of pupils of a human being change according to brightness, it is effective to take the change in the size of pupils into consideration.

The size of the pupil decreases in a bright daytime compared to that in a dark night. Further, the amount of light incident on the retina changes according to the size of the pupil. Therefore, the light incident on the retina is limited in a bight daytime compared to that at night. When the brightness in a daytime is compared with the brightness at night, the difference in brightness that a human being visually perceives is smaller than the actual difference in brightness. The processing device 40 sets the normalizing level and the brightness compression level while taking the above-described change in the size of pupils into consideration.

The normalizing level is set by using the brightness of light coming from the structure 503*a* that reflects light with a 100% reflectivity in a diffused manner (i.e., diffuse-reflected light) as a reference. Specifically, the normalizing level is set according to how much the brightness of light that is emitted from the light source 501 and incident on the viewpoint 506 (direct light), and/or the brightness of light that emitted from the light source 501, specular-reflected, and incident on the viewpoint 506 (specular-reflected light) should be reproduced with respect to the diffuse-reflected light.

In a daytime, the sunlight is much brighter than artificial light such as light form an LED and a fluorescent light. In a daytime, it is very difficult to appropriately reproduce direct light from the sun and specular-reflected light from the sun. Therefore, the normalizing level is set to about 200% to 400% with respect to the brightness of the diffused-reflected light (100%). In contrast to this, at night, the ambient light includes only artificial light and hence the brightness of the diffused-reflected light is lower than that in a daytime. Therefore, the normalizing level is set to a range of about 600% to 4,000% with respect to the brightness of the diffused-reflected light (100%). The brightness compression level is set to the brightness of the diffused-reflected light reflected with a 100% reflectivity. Therefore, the brightness compression level is used as the reference for display by the projector 10. By doing so, the normalizing level and the brightness compression level can be set to appropriate brightness.

As shown in FIG. 6, a normalizing level at twelve noon in fine weather is represented by a normalizing level A and a normalizing level at 3 o'clock in fine weather is represented by a normalizing level B. Further, as shown in FIG. 7, a normalizing level at twelve noon in cloudy/rainy weather is represented by a normalizing level C. Further, the normalizing level B is the same as a normalizing level at 3 o'clock in cloudy/rainy weather. Note that in a case where light coming from the sun is diffused by a cloud, or light that coming from the structure 503*a* disposed on the earth's surface 503 is diffuse-reflected again on a cloud and returns to the earth's surface 503 is simulated, a normalizing level different from the normalizing level B may be defined.

Figure 8:
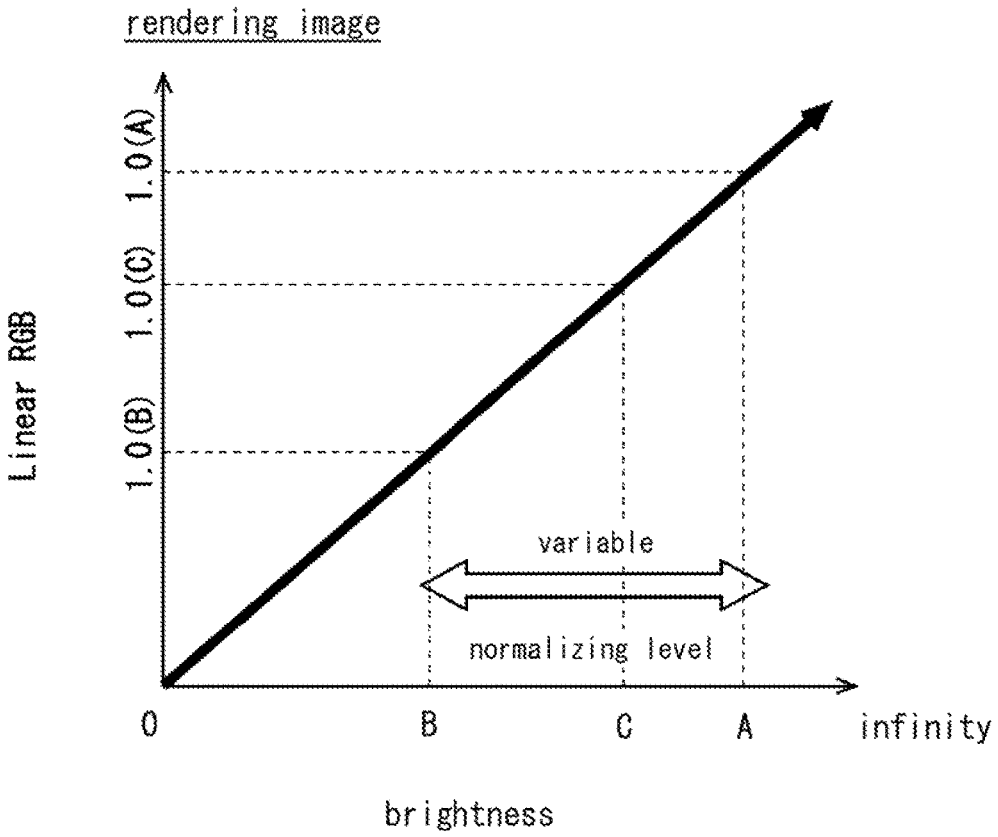
FIG. 8 is a graph showing virtual brightness and normalizing levels A to C of a rendering video image.

The normalizing levels A to C have a relation among them as shown in FIG. 8. The normalizing level A is the highest and the normalizing level B is the lowest. The normalizing level C is between the normalizing levels A and B. Further, the normalizing level is set for each frame. The processing device 40 normalizes a rendering video image so that the brightness in the normalizing level becomes one in each frame.

The processing device 40 sets the normalizing level and the brightness compression level based on brightness information of a scene. Further, the processing device 40 performs an OETF (Optical-Electro Transfer Function) process based on the normalizing level and the brightness compression level. In the OETF process, brightness information is converted into an electric video signal by using an optical-electro transfer function (an OETF). Specifically, the processing device 40 calculates pixel data (R'G'B') in the video signal based on pixel data (linear RGB) of the normalized rendering video image. The OETF process is explained with reference to FIGS. 9 to 11.

Figure 9:
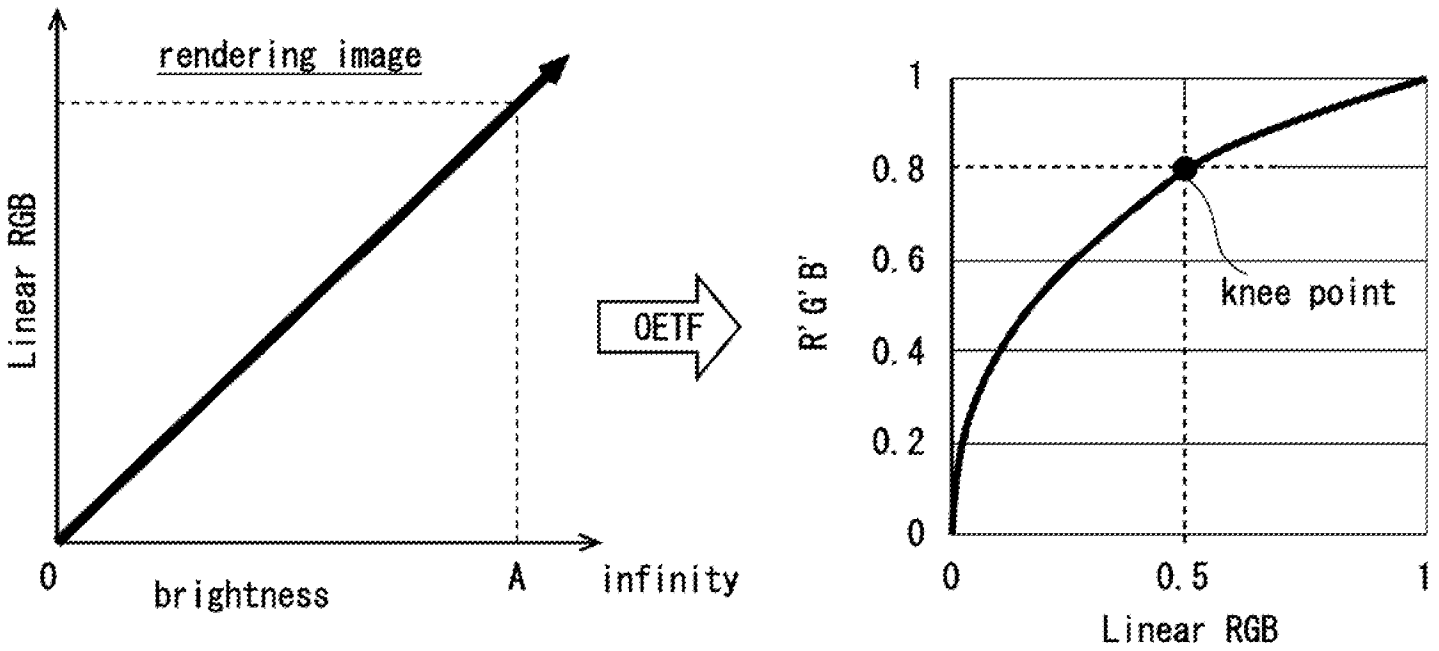
FIG. 9 is a diagram for explaining an OETF process in a normalizing level A.
Figure 10:
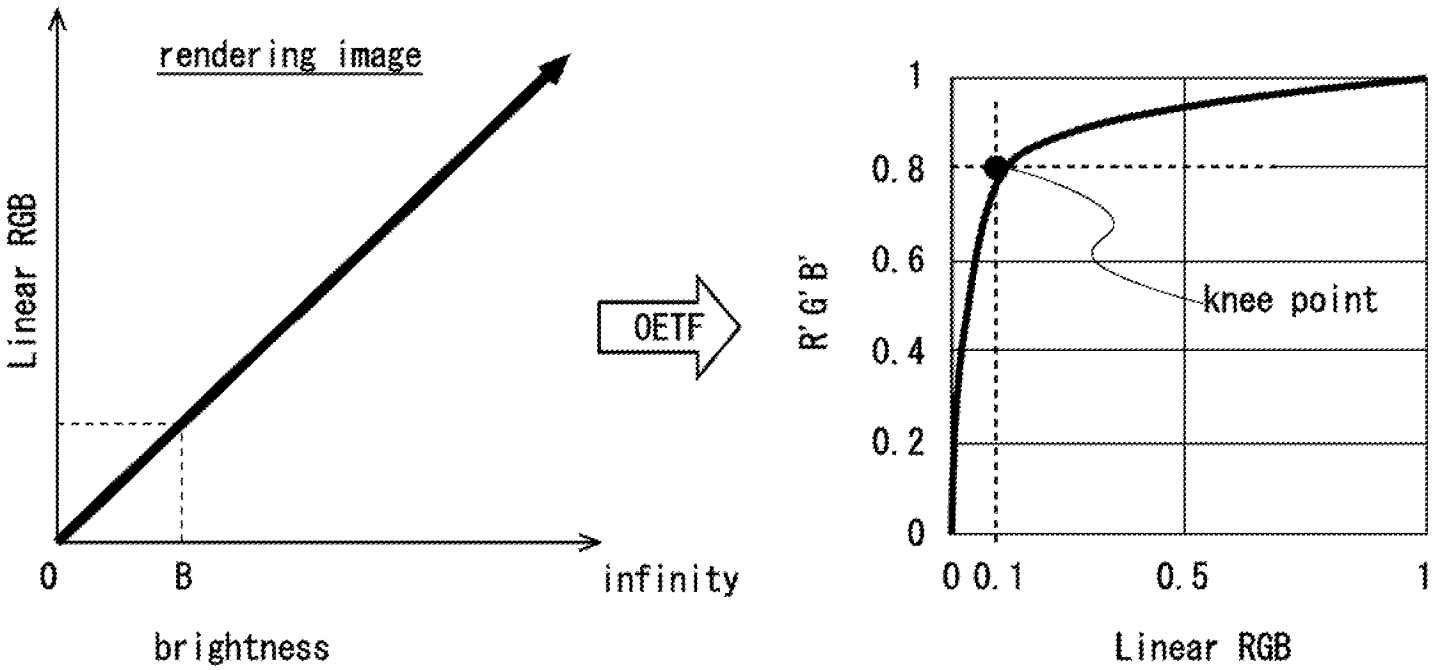
FIG. 10 is a diagram for explaining an OETF process in a normalizing level B.
Figure 11:
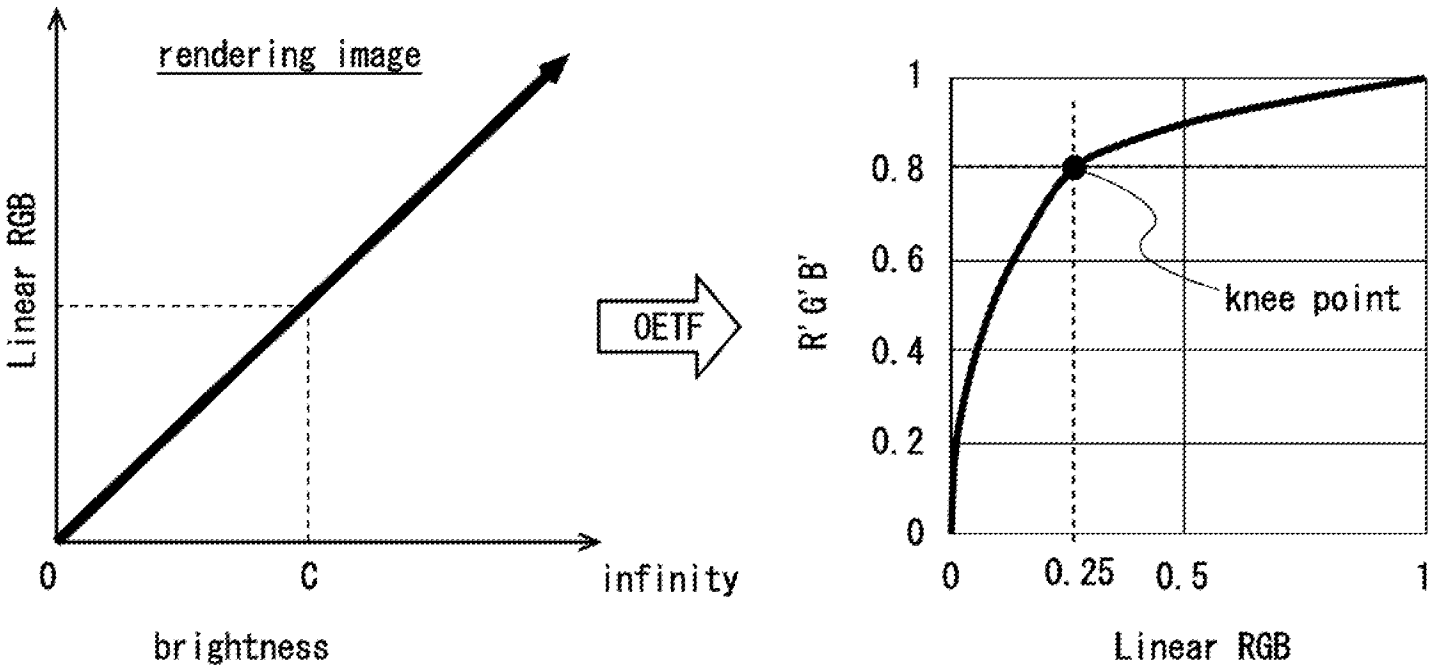
FIG. 11 is a diagram for explaining an OETF process in a normalizing level C.

FIG. 9 shows the OETF process in the normalizing level A. FIG. 10 shows the OETF process in the normalizing level B. FIG. 11 shows the OETF process in the normalizing level C. In each of FIGS. 9 to 11, the graph on the left side shows a relation between virtual brightness of a rendering video image and pixel data (linear RGB) of a normalized rendering video image. Further, the graph on the right side shows a relation between the pixel data (linear RGB) of the normalized rendering video image and pixel data (R'G'B') in a video signal. Therefore, the graph on the right side in each of FIGS. 9 to 11 shows the optical-electro transfer function (the OETF). Further, the graphs on the left sides of FIGS. 9 to 11 are the same as each other, except for the normalizing levels A to C.

In each of the normalizing levels A to C, pixel data (linear RGB) of the normalized rendering video image is in a range of 0 to 1. The gamma γ of the projector 10 is 2.222. In FIGS. 9 to 11, the target of the OETF is 0.8 (=(1/γ)th power of 0.6) so that the brightness compression level becomes 60% of the brightness of the projector 10. Note that the value (1/γ) is 0.45 ((1/γ)=0.45). The OETF process is performed so that the pixel data (R'G'B') in the brightness compression level becomes 0.8.

Letting x represent the pixel data (linear RGB) in the normalized rendering video image and y represent the pixel data (R'G'B') in the video signal, the optical-electro transfer function (the OETF) is expressed as follows. When x is lower than the brightness compression level, $$y=p*x^{(1/\gamma)}.$$

When x is equal to or higher than the brightness compression level, $$y=a*\log(b*x)+c.$$

When x is lower than the brightness compression level, the processing device 40 on the transmitting side performs an ordinary gamma correction. In contrast to this, when x rises to or beyond the brightness compression level, the processing device 40 calculates the pixel data (R'G'B') in the video signal by using logarithm (log) so as to compress the brightness. Note that when x is equal to zero (x=0), y becomes zero (y=0). Further, when x is equal to one (x=1), y becomes one (y=1). Further, as described above, when x is equal to the brightness compression level (knee point), y becomes 0.8 (y=0.8). Further, coefficients a, b, c and p are defined so that the optical-electro transfer function becomes continuous in the brightness compression level. For example, the coefficients a, b, c and p are defined so that the inclination changes smoothly at and around the brightness compression level.

In FIG. 9, the brightness compression level is a half of the normalizing level A (i.e., 0.5). That is, the brightness of a 100% reflectivity corresponds to the brightness compression level and the brightness of a 200% reflectivity corresponds to the normalizing level A. When x is equal to 0.5 (x=0.5), y becomes 0.8 (y=0.8). The coefficients a, b, c and p are 0.664, 2.017, 0.798, and 1.218, respectively (a=0.664, b=2.017, c=0.798, and p=1.218). The brightness of pixels in a range of 0.5 to 1 is compressed.

In FIG. 10, the brightness compression level is one tenth of the normalizing level B (i.e., 0.1). That is, the brightness of a 100% reflectivity corresponds to the brightness compression level and the brightness of a 1,000% reflectivity corresponds to the normalizing level B. When x is equal to 0.1 (x=0.1), y becomes 0.8 (y=0.8). The coefficients a, b, c and p are 0.200, 1.253, 0.980, 6.090, respectively (a=0.200, b=1.253, c=0.980, and p=6.090). The brightness of pixels in a range of 0.1 to 1 is compressed.

In FIG. 11, the brightness compression level is a quarter of the normalizing level C (i.e., 0.25). That is, the brightness of a 100% reflectivity corresponds to the brightness compression level and the brightness of a 400% reflectivity corresponds to the normalizing level C. When x is equal to 0.25 (x=0.25), y becomes 0.8 (y=0.8). The coefficients a, b, c and p are 0.332, 1.378, 0.954, 2.436, respectively (a=0.332, b=1.378, c=0.954, and p=2.436). The brightness of pixels in a range of 0.25 to 1 is compressed.

Note that although y in the brightness compression level in the OETF is fixed to 0.8 in FIGS. 9 to 11, the value of y in the brightness compression level is not limited to 0.8. The value of y can be defined as appropriate according to the brightness or the contrast (the dynamic range) that the projector 10 can display. For example, the higher the dynamic range of the projector 10 is, the more the ratio of the brightness compression is improved. Therefore, the higher the dynamic range of the projector 10 is, the more the value of y in the brightness compression level can be reduced.

In particular, the projector 10 is required to have a wide dynamic range when, for example, there is a pixel having an extremely high brightness level with respect to the average brightness (APL), such as in the case of a scene at night, or when there is a pixel having an extremely low brightness level with respect to the average brightness (APL). For example, in a dark scene corresponding to a scene at night, the brightness compression is performed in a range in which x is in a range of 0.1 to 1.0 as shown in FIG. 10. In a bright scene corresponding to a scene in a daytime in fine weather, the brightness compression is performed only in a range in which x is in a range of 0.5 to 1.0 as shown in FIG. 9. In an intermediate scene corresponding to a scene in a daytime in cloudy/rainy weather, the brightness compression is performed in a range in which x is in a range of 0.25 to 1.0 as shown in FIG. 11. That is, the brightness compression level and the normalizing level are defined in such a manner that the lower the average brightness of a rendering video image is, the wider the brightness compression range becomes. In other words, the brightness compression level and the normalizing level are defined in such a manner that the darker the brightness information of a scene is, the wider the brightness compression range becomes.

<Display of Video Image by Projector 10>

Further, the processing device 40 transmits the video signal including the pixel data (R'G'B') and the brightness control signal in a synchronized manner to the projector 10 through the interface unit 30. Note that the pixel data (R'G'B') is in conformity with RGB 12 bits.

Then, the projector 10 performs an EOTF (Electro-Optical Transfer Function) process. In the EOTF process, the electric video signal is converted into brightness information by using an electro-optical transfer function. Specifically, the spatial modulator 11*b* of the projector 10 modulates the light so that the video image is displayed based on the pixel data (R'G'B') of the video signal. By doing so, the EOTF process can be performed.

Figure 12:
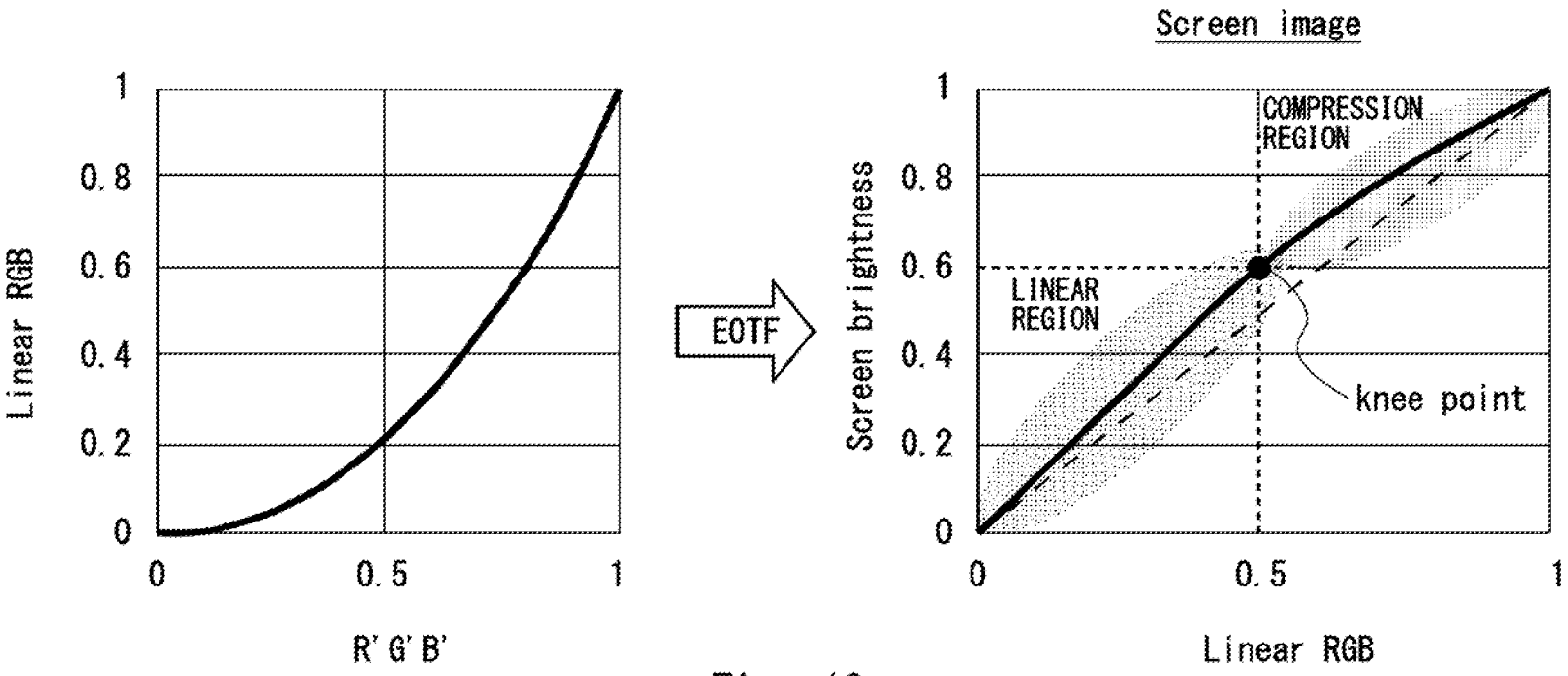
FIG. 12 is a diagram for explaining an EOTF process in a normalizing level A.
Figure 13:
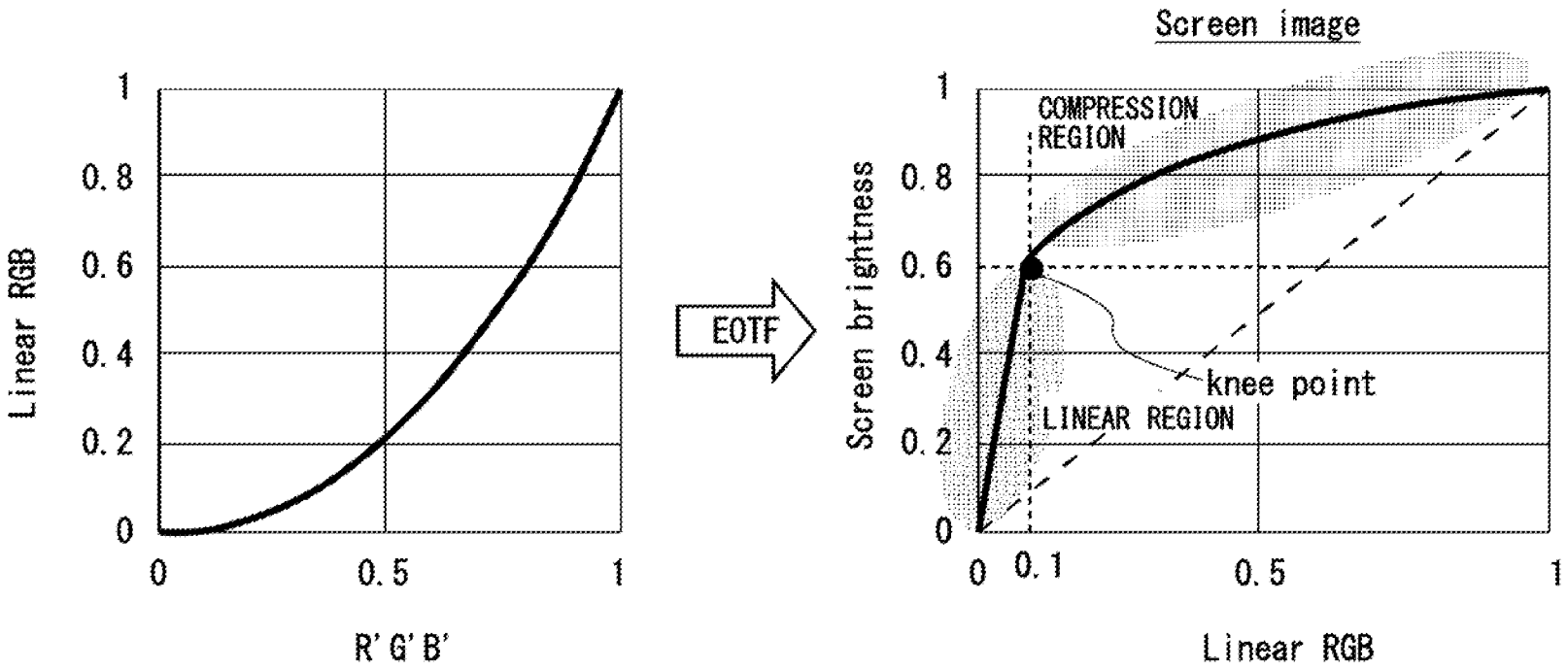
FIG. 13 is a diagram for explaining an EOTF process in a normalizing level B.
Figure 14:
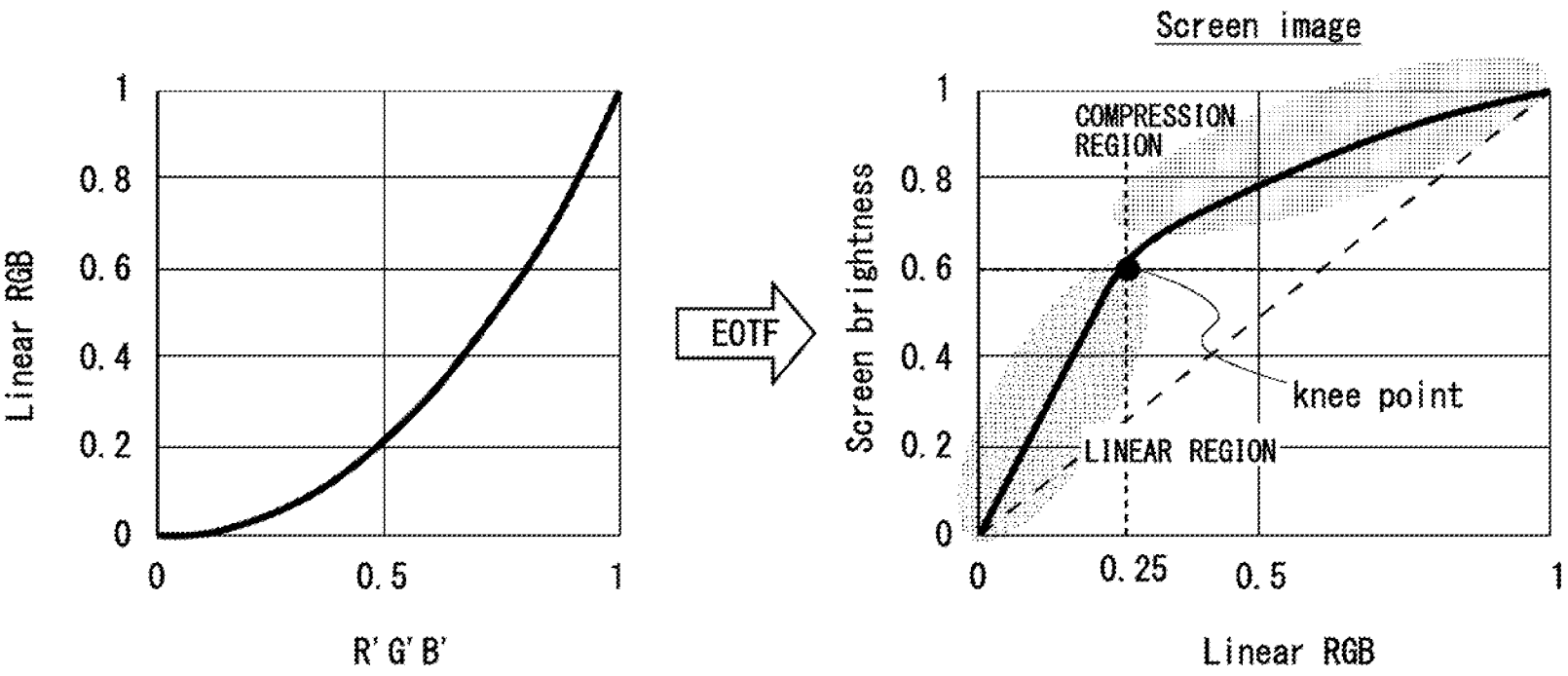
FIG. 14 is a diagram for explaining an EOTF process in a normalizing level C.

The EOTF process is explained with reference to FIGS. 12 to 14. FIG. 12 shows the EOTF process in the normalizing level A. FIG. 13 shows the EOTF process in the normalizing level B. FIG. 14 shows the EOTF process in the normalizing level C. In each of FIGS. 12 to 14, the graph on the left side shows an electro-optical transfer function (EOTF) and the graph on the right side shows a relation between the pixel data (linear RGB) in the normalized rendering video image and the brightness of the pixel (Screen brightness) in the display image (Screen Image).

The electro-optical transfer function is expressed as "$y=x^{\gamma}$". Note that x is the pixel data (R'G'B') of the video signal and y is the pixel data (linear RGB) of the normalized rendering video image. The gamma γ of the projector 10 is 2.222 (γ=2.222). The electro-optical transfer function is unchanged irrespective of the normalizing level.

In the case of the normalizing level A, the relation between the pixel data (linear RGB) of the rendering video image and the brightness (Screen Brightness) of the display video image (Screen Image) displayed by the projector 10 is expressed by the graph shown in FIG. 12. A region in which the pixel data (linear RGB) of the rendering video image is lower than the brightness compression level (0.5) becomes a linear region in which the pixel data (linear RGB) and the brightness of the display video image (Screen Brightness) have a linear relation therebetween. A region in which the pixel data (linear RGB) of the rendering video image is equal to or higher than the brightness compression level (0.5) becomes a compression region in which the brightness is compressed so that the relation between the pixel data (linear RGB) and the brightness of the display video image (Screen Brightness) is expressed by a logarithmic function. The inclination in the linear region is sharper than that in the compression region.

In the case of the normalizing level B, the relation between the pixel data (linear RGB) of the rendering video image and the brightness (Screen Brightness) of the display video image (Screen Image) displayed by the projector 10 is expressed by the graph shown in FIG. 13. A region in which the pixel data (linear RGB) of the rendering video image is lower than the brightness compression level (0.1) becomes a linear region in which the pixel data (linear RGB) and the brightness of the display video image (Screen Brightness) have a linear relation therebetween. A region in which the pixel data (linear RGB) of the rendering video image is equal to or higher than the brightness compression level (0.1) becomes a compression region in which the brightness is compressed so that the relation between the pixel data (linear RGB) and the brightness of the display video image (Screen Brightness) is expressed by a logarithmic function. The inclination in the linear region is sharper than that in the compression region.

In the case of the normalizing level C, the relation between the pixel data (linear RGB) of the rendering video image and the brightness (Screen Brightness) of the display video image (Screen Image) displayed by the projector 10 is expressed by the graph shown in FIG. 14. A region in which the pixel data (linear RGB) of the rendering video image is lower than the brightness compression level (0.25) becomes a linear region in which the pixel data (linear RGB) and the brightness of the display video image have a linear relation therebetween. A region in which the pixel data (linear RGB) of the rendering video image is equal to or higher than the brightness compression level (0.25) becomes a compression region in which the brightness is compressed so that the relation between the pixel data (linear RGB) and the brightness of the display video image (Screen Brightness) is expressed by a logarithmic function. The inclination in the linear region is sharper than that in the compression region.

As described above, the compression range changes according to the normalizing level, i.e., according to the brightness information of the scene. The compression range becomes narrower in a bright scene (e.g., the normalizing level A) and it becomes wider in a dark scene (e.g., the normalizing level B). The difference in display brightness according to the difference in gradation value in the compression region (i.e., the compression range) is smaller than that in the linear region.

Figure 15:
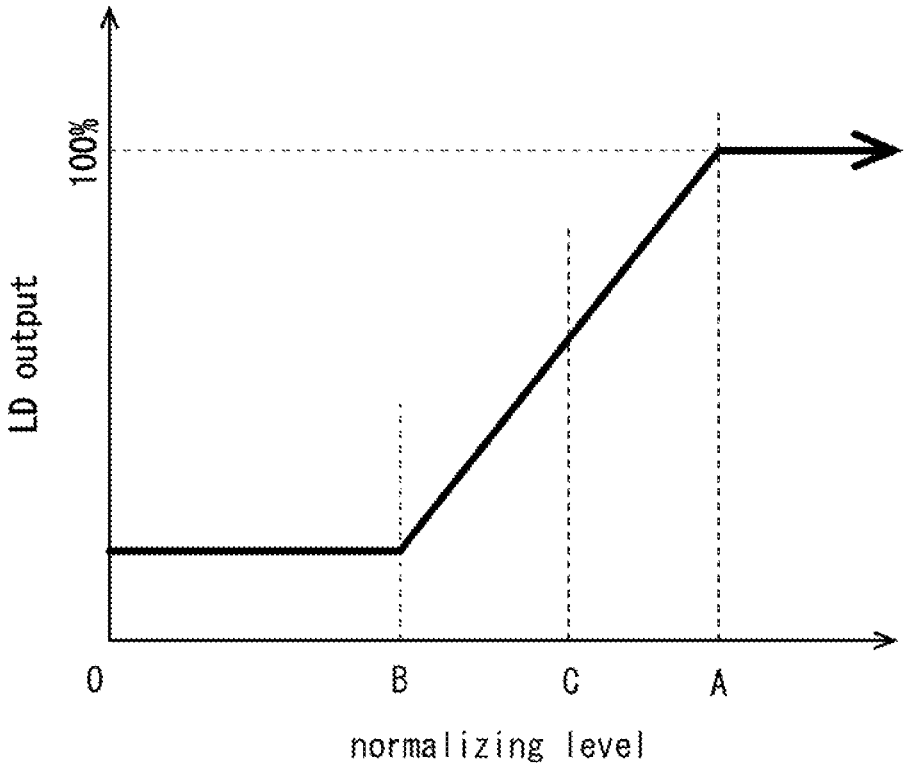
FIG. 15 is a graph showing a relation between normalizing levels and light source outputs.

Further, the projector 10 controls the light source 11*a* according to the brightness control signal. The output of the light source 11*a* (the LD output) changes according to the brightness control signal. FIG. 15 is a graph showing a relation between normalizing levels and outputs of the light source 11*a* (i.e., LD outputs). The brighter the scene is, the higher the normalizing level becomes. Therefore, the higher the normalizing level is, the larger the output of the light source 11*a* (the LD output) becomes. Conversely, the darker the scene is, the higher the normalizing level becomes. Therefore, the lower the normalizing level is, the smaller the output of the light source 11*a* (the LD output) becomes. The higher the normalizing level is, the brighter the scene is. Therefore, the brightness control signal is set so that the output of the light source 11*a* is increased.

As described above, in the projector 10, the output of the light source 11*a* is controlled according to the brightness control signal. Further, the spatial modulator 11*b* modulates light emitted from the light source 11*a* according to the pixel data (R'G'B') of the video signal. By doing so, the projector 10 can appropriately display a CG video image.

Since the brightness information is set on a frame-by-frame basis, the brightness control signal is optimized on a frame-by-frame basis. In this way, the projector 10 can display a display video image with brightness that is determined according to brightness of a scene on a frame-by-frame basis. The projector 10 displays a CG video image with a wide dynamic range on a frame-by-frame basis.

Further, the brightness compression level and the normalizing level can be changed for each frame. Therefore, pixel data of a rendering video image can be appropriately compressed. Human eyes are more sensitive to a difference in gradation in a dark area in a frame than that in a bright area in the frame. Therefore, by displaying video image while compressing brightness equal to or higher than the brightness compression level, it is possible to increase the number of gradation levels for a dark area. In this way, it is possible to improve the gradation property and thereby appropriately display CG video images of various scenes.

Although there is a limit to the brightness that the projector 10 can display, it is possible to provide an effect that is perceptively similar to the visual perception of a human being in a real world (e.g., provides a dazzling sensation) by the above-described image processing. In particular, in the case where there is an artificial light source in a night scene in which the whole image is dark, it is possible to appropriately express glare of the light source 501 and also possible to appropriately express the gradation in the dark area other the light source. Further, when the output of the light source 11*a* is large in a bright daytime scene, it is possible to display a video image with a wide dynamic range.

As described above, the processing device 40 sets the normalizing level, the brightness compression level, and the brightness control signal for each frame. In this way, it is possible to appropriately display a CG video image according to the scene.

<Configuration Example of Interface Unit 30>

Note that the processing device 40 may transmit the brightness control signal to the projector 10 through an external control I/F different from the I/F for the video signal. In such a case, the interface unit 30 includes both the I/F for the video signal and the external control I/F for the brightness control signal. Further, the processing device 40 transmits the video signal and the brightness control signal in a synchronized manner.

Alternatively, the processing device 40 may transmit the brightness control signal to the projector 10 through the same I/F as the I/F for the video signal. When the brightness control signal is transmitted by using the I/F for the video signal, the brightness control signal may be embedded in a part of the video signal. For example, it is possible to embed the brightness control signal in pixel data corresponding to a plurality of first pixels in a frame (i.e., a plurality of pixels at the head of a frame). For example, in the case where the brightness control signal is an n-bit signal (n is an integer no less than one), the brightness control signal may be embedded in low-order bits of first n pixel data. In this way, it is possible to reduce the influence on the display video image.

Alternatively, the brightness control signal may be embedded in pixel data of the first pixel. In such a case, the projector 10 may display a CG video image without using the pixel data of the first pixel, so that the influence on the display video image can be reduced. Alternatively, it is possible to add the brightness control signal in a packet that is transmitted for each frame as in the case of an HDMI and a DisplayPort.

Figure 16:
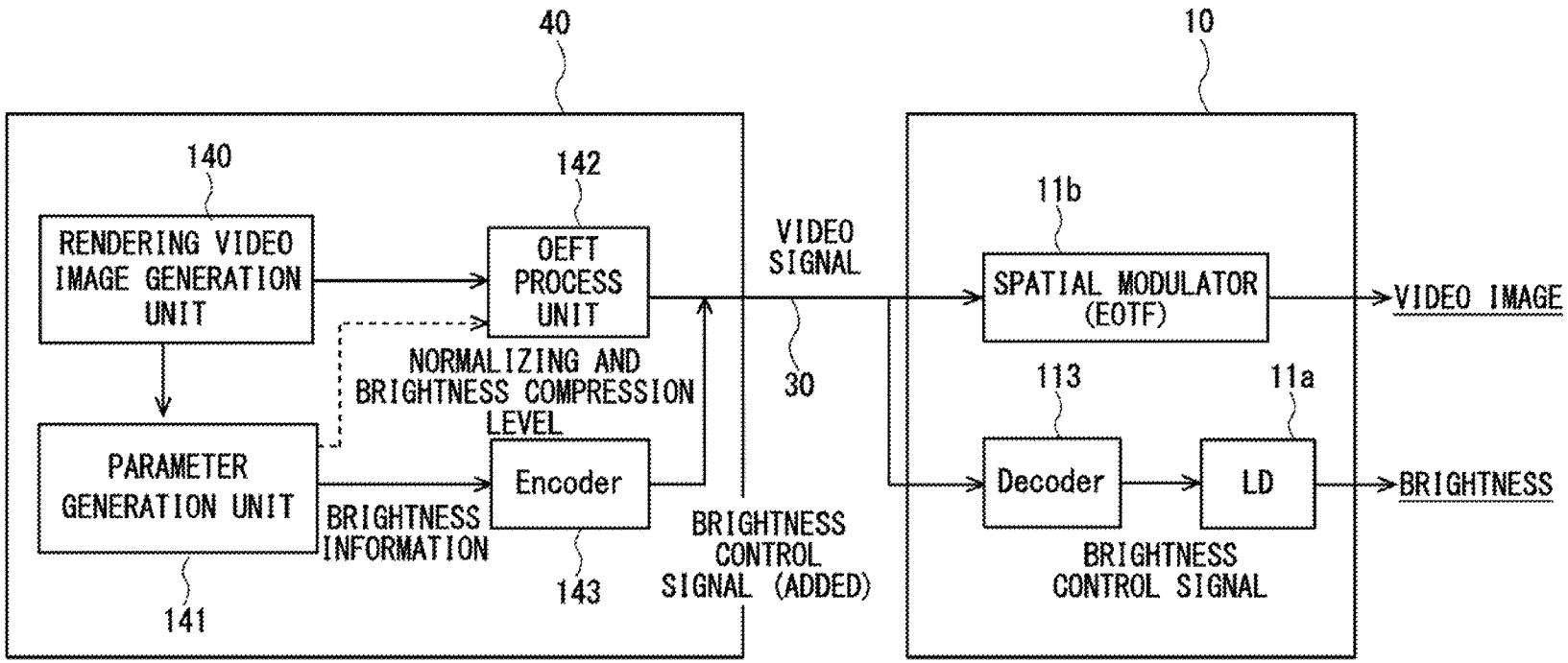
FIG. 16 is a block diagram showing an example of a configuration for transmitting a brightness control signal.

FIG. 16 shows an example of a configuration for transmitting a brightness control signal. The processing device 40 includes a rendering video image generation unit 140, a parameter generation unit 141, an OETF process unit 142, and an encoder 143. The projector 10 includes a light source 11*a*, a spatial modulator 11*b*, and a decoder 113. Note that explanations of the already-explained processes are omitted as appropriate.

The rendering video image generation unit 140 performs modeling of an object and thereby generates a rendering video image. The rendering video image generation unit 140 outputs the rendering video image to the parameter generation unit 141 and the OETF process unit 142.

The parameter generation unit 141 generates a normalizing level, a brightness compression level, and brightness information based on the rendering video image. Note that the parameter generation unit 141 calculates an average brightness APL of the rendering video image as the brightness information. The parameter generation unit 141 calculates the brightness compression level and the normalizing level based on the average brightness APL of the rendering video image.

The parameter generation unit 141 outputs the brightness compression level and the normalizing level to the OETF process unit 142. The OETF process unit 142 performs an OETF process based on the brightness compression level and the normalizing level. The OETF process unit 142 generates a video signal including pixel data (R'G'B') by normalizing the rendering video image and compressing its brightness.

The parameter generation unit 141 outputs the brightness information to the encoder 143. The encoder 143 generates a brightness control signal based on the brightness information. The brightness control signal is encoded (or embedded) into the video signal. For example, the brightness control signal is added in the first pixel of a frame. Alternatively, the brightness control signal is added in a packet that is transmitted for each frame.

The processing device 40 transmits the video signal to the projector 10 through the interface unit 30. The decoder 113 decodes the video signal and extracts the brightness control signal. That is, the decoder 113 separates the brightness control signal from the pixel data. Then, the decoder 113 outputs the brightness control signal to the light source 11*a*. The light source 11*a* includes an output controller that controls the output of the light source 11*a* according to the brightness control signal.

The spatial modulator 11*b* is an LCOS panel or the like, and performs an EOTF process. That is, the spatial modulator 11*b* modulates light emitted from the light source 11*a* according to the pixel data (R'G'B') included in the video signal. In this way, a CG video image according to the pixel data (R'G'B') is displayed.

Note that the brightness control signal may represent a value indicating the output (%) of the light source 11*a*. Alternatively, the brightness control signal may represent virtual brightness of the rendering video image corresponding to the normalizing level. Further, the processing device 40 may transmit information about the normalizing level and the brightness compression level together with the brightness control signal. By transmitting the brightness compression level to the projector 10, it is possible to make the electro-optical transfer function (EOTF) identical to the inverse function of the optical-electro transfer function (the OETF). In this way, the rendering video image can be appropriately reproduced.

By transmitting the brightness compression level to the projector 10, it is possible to generate the electro-optical transfer function (EOTF) as the inverse function of the optical-electro transfer function (the OETF) on the projector 10 side. It is possible to restore the brightness of the original rendering video image (i.e., the rendering video image before performing the brightness compression) on the projector 10 side. In this way, it is possible to perform reversible brightness compression.

For example, for a pixel for which x is lower than the brightness compression level, its brightness before the compression (hereinafter referred to as "pre-compression brightness") can be obtained by the inverse function of the function "$y=p*x^{(1/\gamma)}$". For a pixel for which x is equal to or higher than the brightness compression level, its pre-compression brightness can be obtained by the inverse function of the function "$y=a*\log(b*x)+c$". Further, gradation values are generated so that the video image is displayed with the pre-compression brightness by the projector 10.

Further, when a projector 10 having a wide dynamic range is used, it is also possible to display a bright scene without compressing the brightness. For example, in FIG. 9, the target of the OETF corresponding to the brightness compression level is 0.8. In a projector having a wide dynamic range, the brightness compression range can be narrowed. Therefore, the value of the target of the OETF can be decreased. In other words, when a projector 10 capable of decreasing the value of the target of the OETF is used, there is no need to compress brightness for a bright scene.

Further, a CG video image generated by the processing device 40 may be displayed by a plurality of projectors 10. A user's field of view may be divided into a plurality of sections and a plurality of projectors 10 may project a CG video image. By doing go, it is possible to enlarge the display screen. In such a case, the plurality of projectors 10 may use the same brightness control signal.

The processing device 40 may set the brightness compression range according to the display characteristic of the display device. For example, in the above explanation, the brightness compression level and the normalizing level are set in such a manner that the darker the brightness of a scene is, the more the brightness compression range is increased. However, the brightness compression level and the normalizing level may be set in such a manner that the brighter the brightness of a scene is, the more the brightness compression range is increased.

In the case of an organic EL display, it is very difficult to achieve an appropriate gradation expression on the high-brightness side, though an appropriate gradation expression can be achieved on the low-brightness side. That is, the difference in brightness corresponding to the difference in gradation value is reduced in pixels on the high-brightness side. In such a case, the processing device 40 sets the brightness compression level in such a manner that the brighter the brightness of a scene is, the more the brightness compression level is increased.

Further, only the brightness on the low-brightness side may be compressed while the brightness on the high-brightness side is not compressed. Further, in such a case, the normalizing level may be set to a level other than the level corresponding to the upper limit of the brightness in a frame. That is, the processing device 40 can set the normalizing level and the brightness compression level to appropriate levels according to the display characteristic of the display device.

Some or all of the above-described processes may be performed by using a computer program. The above-described program can be stored in various types of non-transitory computer readable media and thereby supplied to the computer. The non-transitory computer readable media includes various types of tangible storage media. Examples of the non-transitory computer readable media include a magnetic recording medium (such as a flexible disk, a magnetic tape, and a hard disk drive), a magneto-optic recording medium (such as a magneto-optic disk), a CD-ROM (Read Only Memory), a CD-R, and a CD-R/W, and a semiconductor memory (such as a mask ROM, a PROM (Programmable ROM), an EPROM (Erasable PROM), a flash ROM, and a RAM (Random Access Memory)). Further, the program can be supplied to the computer by using various types of transitory computer readable media. Examples of the transitory computer readable media include an electrical signal, an optical signal, and an electromagnetic wave. The transitory computer readable media can be used to supply programs to the computer through a wire communication path such as an electrical wire and an optical fiber, or wireless communication path. Further, the above-described processes are performed by having the processor 41 execute instructions stored in the memory 42.

The present disclosure made by the inventors of the present application has been explained above in a concrete manner based on embodiments. However, the present disclosure is not limited to the above-described embodiments, and needless to say, various modifications can be made without departing from the spirit and scope of the present disclosure.

While the invention has been described in terms of several embodiments, those skilled in the art will recognize that the invention can be practiced with various modifications within the spirit and scope of the appended claims and the invention is not limited to the examples described above.

Further, the scope of the claims is not limited by the embodiments described above.

Furthermore, it is noted that, Applicant's intent is to encompass equivalents of all claim elements, even if amended later during prosecution.

What is claimed is:

1. A processing device comprising:

a processor configured to generate a video signal for displaying a CG video image according to a scene; and an interface that can be connected to a display device;

the processor being configured to:

perform a rendering of a rendering video image based on object information about an object;

generate a normalizing level, a brightness compression level, and a brightness control signal for setting brightness of a frame of a display video image based on brightness information of the scene;

generate a video signal including pixel data of the display video image from the rendering video image by compressing brightness of a pixel present in a brightness compression range specified by the brightness compression level and the normalizing level in the rendering video image;

embed or add the brightness control signal into the video signal; and transmit the video signal to the display device through the interface, wherein the normalizing level and the brightness compression level is set based on a display characteristic of the display device, wherein the normalized level is an estimated maximum brightness corresponding to an upper limit of the brightness information in the frame, the estimated maximum brightness being higher than a brightness of light coming from a structure in the rendering video image that reflects light with a 100% reflectivity in a diffused manner, and wherein the brightness compression level is lower than the normalizing level.

2. The processing device according to claim 1, wherein the brightness compression level and the normalizing level are set in such a manner that the darker the brightness of a scene is, the more the brightness compression range is increased.

3. The processing device according to claim 1, wherein the brightness compression level and the normalizing level are set in such a manner that the brighter the brightness of a scene is, the more the brightness compression range is increased.

4. The processing device according to claim 1, wherein the brightness information is set based on the rendering video image.

5. The processing device according to claim 1, wherein the brightness information is set as a function or a table according to time.

6. The processing device according to claim 1, the rendering image has virtual brightness higher than the video image displayed by the display device.

7. The processing device according to claim 1, wherein a bit length of a pixel data in the rendering image is larger than a bit length of the pixel data in the video signal.

8. A display system comprising:

a processing device according to claim 1; and the display device configured to display the CG video image based on the video signal.

9. The display system according to claim 8, wherein the display device comprises:

a light source; and a spatial modulator configured to modulate light emitted from the light source based on the video signal, and an output of the light source is controlled based on the brightness control signal.

10. A display method for displaying a CG video image according to a scene, comprising:

performing, by a processor, a rendering of a rendering video image based on object information about an object;

generating, by the processor, a normalizing level, a brightness compression level, and a brightness control signal for setting brightness of a frame of a display video image based on brightness information of the scene;

generating, by the processor, a video signal including pixel data of the display video image from the rendering video image by compressing brightness of a pixel present in a brightness compression range specified by the brightness compression level and the normalizing level in the rendering video image;

embedding or adding, by the processor, the brightness control signal into the video signal;

transmitting, by the processor, the video signal to the display device through an interface that can be connected to the display device; and displaying, by the display device, the CG video image based on the video signal with brightness corresponding to the brightness control signal, wherein the normalizing level and the brightness compression level is set based on a display characteristic of a display device, wherein the normalized level is an estimated maximum brightness corresponding to an upper limit of the brightness information in the frame, the estimated maximum brightness being higher than a brightness of light coming from a structure in the rendering video image that reflects light with a 100% reflectivity in a diffused manner, and wherein the brightness compression level is lower than the normalizing level.

11. A non-transitory computer readable medium storing a program for generating a video signal for displaying a CG video image according to a scene, the program being adapted to cause a computer to:

perform a rendering of a rendering video image based on object information about an object;

generate a normalizing level, a brightness compression level, and a brightness control signal for setting brightness of a frame of a display video image based on brightness information of the scene;

generate a video signal including pixel data of the display video image from the rendering video image by compressing brightness of a pixel present in a range specified by the brightness compression level and the normalizing level in the rendering video image;

embed or add the brightness control signal into the video signal; and transmit the video signal to the display device through an interface configured to connect the computer to a display device, wherein the normalizing level and the brightness compression level is set based on a display characteristic of the display device, wherein the normalized level is an estimated maximum brightness corresponding to an upper limit of the brightness information in the frame, the estimated maximum brightness being higher than a brightness of light coming from a structure in the rendering video image that reflects light with a 100% reflectivity in a diffused manner, and wherein the brightness compression level is lower than the normalizing level.

* * * * *